US009351363B1

(12) United States Patent
Hsu et al.

(10) Patent No.: US 9,351,363 B1
(45) Date of Patent: May 24, 2016

(54) DUAL MODE OPERATION LIGHT-EMITTING DIODE LIGHTING DEVICE HAVING MULTIPLE DRIVING STAGES

(71) Applicant: IML International, Grand Cayman (KY)

(72) Inventors: Horng-Bin Hsu, Taipei (TW); Yung-Hsin Chiang, New Taipei (TW)

(73) Assignee: IML International, Grand Cayman (KY)

( * ) Notice: Subject to any disclaimer, the term of this patent is extended or adjusted under 35 U.S.C. 154(b) by 0 days.

(21) Appl. No.: 14/872,116

(22) Filed: Sep. 30, 2015

Related U.S. Application Data

(60) Provisional application No. 62/082,149, filed on Nov. 20, 2014.

(51) Int. Cl.
*H05B 31/00* (2006.01)
*H05B 33/08* (2006.01)

(52) U.S. Cl.
CPC ..... *H05B 33/0824* (2013.01); *H05B 33/0827* (2013.01)

(58) Field of Classification Search
None
See application file for complete search history.

(56) References Cited

U.S. PATENT DOCUMENTS 5,754,064 A * 5/1998 Chien ..... H05B 33/08 315/169.3
7,132,804 B2 * 11/2006 Lys ..... H05B 33/0803 315/292
9,049,765 B1 * 6/2015 Powell ..... H05B 33/0809
2004/0062059 A1 * 4/2004 Cheng ..... B60L 11/1814 363/17
2007/0171145 A1 * 7/2007 Coleman ..... H05B 33/0812 345/39
2008/0088247 A1 * 4/2008 Ger ..... H05B 41/2822 315/209 R
2009/0021185 A1 * 1/2009 Ng ..... H05B 33/0812 315/294
2010/0231135 A1 * 9/2010 Hum ..... H05B 33/0815 315/250
2011/0084618 A1 * 4/2011 Kang ..... H05B 33/0809 315/185 R
2012/0274216 A1 * 11/2012 Datta ..... H05B 33/0815 315/127
2013/0162157 A1 * 6/2013 Suzuki ..... H02M 7/217 315/201
2014/0300278 A1 * 10/2014 Van Bodegraven ..... H05B 33/0827 315/153
2014/0333219 A1 * 11/2014 Zijlstra ..... H05B 33/0809 315/192
2014/0354157 A1 * 12/2014 Morales ..... H05B 33/083 315/122
2014/0361695 A1 * 12/2014 Akiyama ..... H05B 33/0812 315/185 R
2015/0035443 A1 * 2/2015 Hill ..... H05B 33/0857 315/192
2015/0130363 A1 * 5/2015 Lee ..... H05B 33/0845 315/201
2015/0373799 A1 * 12/2015 Bong ..... H05B 39/06 315/201
2016/0007420 A1 * 1/2016 Gong ..... H05B 33/0812 315/187

* cited by examiner

*Primary Examiner* — Crystal L Hammond
(74) *Attorney, Agent, or Firm* — Winston Hsu; Scott Margo

(57) ABSTRACT

An LED lighting device includes first and second luminescent units, first and second current controllers, a line voltage sensing unit and a mode control unit. The first current controller with a first current setting is selectively coupled to the first luminescent unit according to a sensing voltage associated a range of the rectified AC voltage. The second current controller with a second current setting is coupled in series to the second luminescent unit. The line voltage sensing unit is configured to detect the sensing voltage. The mode control unit is configured to operate the LED lighting device in a first driving mode when detecting that the rectified AC voltage is within a first AC range and operate the LED lighting device in a second driving mode when detecting that the rectified AC voltage is within a second AC range.

9 Claims, 5 Drawing Sheets

DUAL MODE OPERATION LIGHT-EMITTING DIODE LIGHTING DEVICE HAVING MULTIPLE DRIVING STAGES

CROSS REFERENCE TO RELATED APPLICATIONS

This application claims the benefit of U.S. provisional application No. 62/082,149 filed on Nov. 20, 2014.

BACKGROUND OF THE INVENTION

1. Field of the Invention

The present invention is related to an LED lighting device having multiple driving stages, and more particularly, to an LED lighting device having multiple driving stages and capable of providing dual mode operations for two AC voltage ranges.

2. Description of the Prior Art

An LED lighting device directly driven by a rectified alternative-current (AC) voltage usually adopts a plurality of LEDs coupled in series in order to provide required luminance. In a conventional method for driving an LED lighting device, the LEDs may be light up in multiple stages in order to increase the effective operational voltage range.

The voltage and frequency of general-purpose AC electricity vary from country to country throughout the world. Typically, mains electricity either adopts 110-volt (110V), 120-volt (120V), 220-volt (220V) or 230-volt (230V) in voltage and 50-Herts (50 Hz) or 60-Herts (60 Hz) in frequency. For commercial and industrial applications, a higher voltage is often required, such as 277-volt (277V) used in the United States of America. It is to be noted that these voltage values are averages, since the voltage does fluctuate during usage. While a switching-type LED lighting device can operate within a large voltage range (such as 85V-265V), a linear-type LED lighting device is designed to only operate at a specific voltage. More specifically, when a linear-type LED lighting device either adopts a 110V driving scheme or a 220V driving scheme, it can function normally as long as the rectified AC voltage is within a certain small range, such as 110V±10% or 220V±10%. However, when a linear-type LED lighting device adopting the 110V driving scheme is used in a country with 220V mains electricity, system failure may occur due to over-rated power; when a linear-type LED lighting device adopting the 220V driving scheme is used in a country with 110V mains electricity, not all LEDS can be illuminated due to insufficient power. Therefore, there is a need for an LED lighting device having multiple driving stages and capable of providing dual mode operations for two voltage ranges.

SUMMARY OF THE INVENTION

The present invention provides an LED lighting device having multiple driving stages and providing automatic mode switching. The LED lighting device includes a first luminescent unit, a second luminescent unit, a first current controller, a second current controller, a line voltage sensing unit and a mode control unit. The first luminescent unit is driven by a rectified AC voltage and includes a plurality of luminescent devices coupled in series. The second luminescent unit is driven by the rectified AC voltage and includes a plurality of luminescent devices coupled in series. The first current controller is selectively coupled in series to the first luminescent unit according to a sensing voltage associated a range of the rectified AC voltage and configured to provide a first current setting. The second current controller is coupled in series to the second luminescent unit and configured to provide a second current setting. The line voltage sensing unit is configured to detect the sensing voltage. The mode control unit is configured to operate the LED lighting device in a first driving mode when the sensing voltage indicates that the rectified AC voltage is within a first AC range by coupling the first current controller to the first luminescent unit and allowing the first luminescent unit and the second luminescent unit to be coupled in parallel with each other; operate the LED lighting device in a second driving mode when the sensing voltage indicates that the rectified AC voltage is within a second AC range by isolating the first current controller from the first luminescent unit and allowing the first luminescent unit and the second luminescent unit to be coupled in series to each other. The first current controller is configured to regulate first current flowing through the first luminescent unit so that the first current does not exceed the first current setting and the second current controller is configured to regulate second current flowing through the second luminescent unit so the second current does not exceed the second current setting when the LED lighting device operates in the first driving mode. The first current controller is turned off and the second current controller is configured to regulate third current flowing through the first luminescent unit and the second luminescent unit so that the third current does not exceed the second current setting when the LED lighting device operates in the second driving mode.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
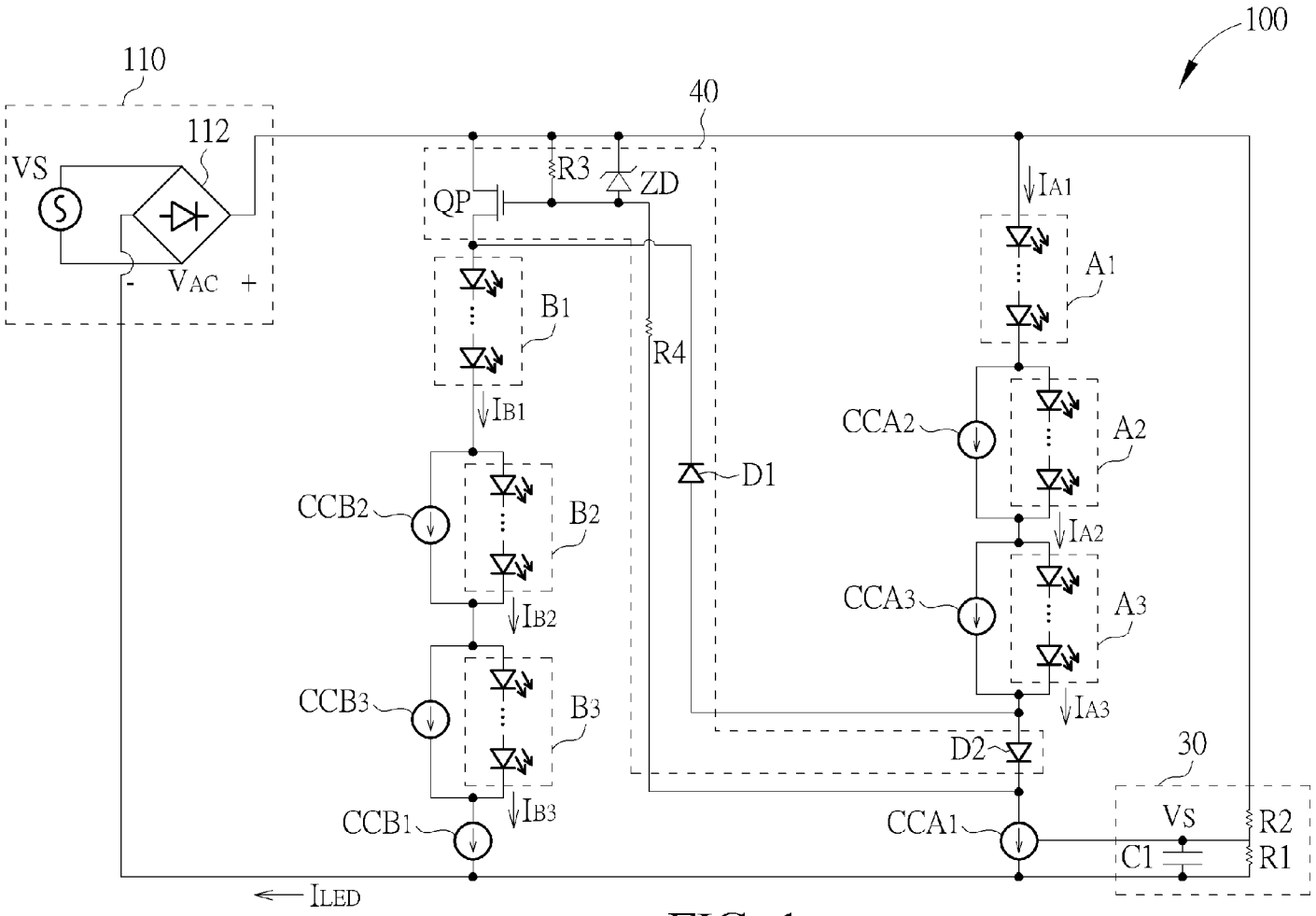
FIG. 1 is a diagram of an LED lighting device 100 according to an embodiment of the present invention.

FIG. 1 is a diagram of an LED lighting device 100 according to an embodiment of the present invention. The LED lighting device 100 includes a power supply circuit 110, a first luminescent unit having N luminescent devices $A_1$~$A_N$, a second luminescent unit having N luminescent devices $B_1$~$B_N$, N current control units $CCA_1$~$CCA_N$, N current control units $CCB_1$~$CCB_N$, a line voltage sensing unit 30, and a mode control unit 40, wherein N is an integer larger than 1. For illustrative purpose, FIG. 1 depicts the embodiment of N=3 in which the LED lighting device 100 is driven in 3 stages. However, the value of N does not limit the scope of the present invention.

For illustrative purposes, the following symbols are used to explain the operation of the LED lighting device 100 throughout the description and figures. $I_{A1}$~$I_{A3}$ represent the current flowing through the luminescent devices $A_1$~$A_3$, respectively. $I_{B1}$~$I_{B3}$ represent the current flowing through the luminescent devices $B_1$~$B_3$, respectively. $I_{LED}$ represents the overall current flowing through the LED lighting device 100.

The power supply circuit 110 is configured to receive an AC voltage VS having positive and negative periods and convert the output of the AC voltage VS in the negative period using a bridge rectifier 112, thereby providing a rectified AC voltage $V_{AC}$, whose value varies periodically with time, for driving the LED lighting device 100. In another embodiment, the power supply circuit 110 may receive any AC voltage VS, perform voltage conversion using an AC-AC converter, and rectify the converted AC voltage VS using the bridge rectifier 112, thereby providing the rectified AC voltage $V_{AC}$ whose value varies periodically with time. The configuration of the power supply circuit 110 does not limit the scope of the present invention.

The LED lighting device 100 may operate in a first driving mode when the rectified AC voltage $V_{AC}$ is within a first AC range, or operate in a second driving mode when the rectified AC voltage $V_{AC}$ is within a second AC range. In the present invention, the nominal value of the second AC range is larger than the nominal value of the first AC range. In an embodiment, the nominal value of the first AC range may be 110V, and the nominal value of the second AC range may be 220V. However, the nominal values of the first and second AC ranges do not limit the scope of the present invention.

In an embodiment, the LED lighting device 100 may operate in a 110V driving mode when the rectified AC voltage $V_{AC}$ is within a 110V AC range, or operate in a 220V driving mode when the rectified AC voltage $V_{AC}$ is within a 220V AC range. The 110V AC range refers to a voltage range with a nominal value of 110V and a range of tolerance above and below the nominal value, and the 220V AC range refers to a voltage range with a nominal value of 220V and a range of tolerance above and below the nominal value. For example, the 110V AC range may be 110V+A %/−B %, and the 220V AC range may be 110V+C %/−D %. Each of the 110V AC range and the 220V AC range may have a symmetric tolerance range (A=B, C=D) or an asymmetric tolerance range (A≠B, C≠D). However, the values of A, B, C and D do not limit the scope of the present invention.

In the present invention, each of the luminescent devices $A_1$~$A_N$ and $B_1$~$B_N$ may adopt a single LED or multiple LEDs coupled in series. FIG. 1 depict the embodiment using multiple LEDs which may consist of single-junction LEDs, multi-junction high-voltage (HV) LEDs, or any combination of various types of LEDs. However, the types and configurations of the luminescent devices $A_1$~$A_N$ and $B_1$~$B_N$ do not limit the scope of the present invention. In a specific driving stage, the dropout voltage for turning on the corresponding current control unit is smaller than the cut-in voltage for turning on the corresponding luminescent device. When the voltage established across a specific luminescent device exceeds its cut-in voltage, the specific luminescent device may be placed in a conducting ON state; when the voltage established across the specific luminescent device does not exceed its cut-in voltage, the specific luminescent device may be placed in a non-conducting OFF state. The value of the cut-in voltage is related to the number or type of the LEDs in the corresponding luminescent device and may vary in different applications.

In the LED lighting device 100, the current control unit $CCA_1$ with a current setting $I_{SET_A1}$ is selectively coupled in series to the luminescent devices $A_1$~$A_3$ via the mode control unit 40, the current control unit $CCA_2$ with a current setting $I_{SET_A2}$ is coupled in parallel with the luminescent device $A_2$, the current control unit $CCA_3$ with a current setting $I_{SET_A3}$ is coupled in parallel with the luminescent device $A_3$, the current control unit $CCB_1$ with a current setting $I_{SET_B1}$ is coupled in series to the luminescent devices $B_1$~$B_3$, the current control unit $CCB_2$ with a current setting $I_{SET_B2}$ is coupled in parallel with the luminescent device $B_2$, and the current control unit $CCB_3$ with a current setting $I_{SET_B3}$ is coupled in parallel with the luminescent device $B_3$. Therefore, the luminescent devices $A_1$~$A_3$ may be driven in 3 driving stages using the corresponding current control units $CCA_1$~$CCA_3$, and the luminescent devices $B_1$~$B_3$ may be driven in 3 driving stages using the corresponding current control units $CCB_1$~$CCB_3$. More specifically, the current control units $CCA_2$~$CCA_3$ are configured to regulate the current $I_{A2}$~$I_{A3}$ so that the current $I_{A2}$~$I_{A3}$ does not exceed the maximum current settings $I_{SET_A2}$~$I_{SET_A3}$ of the current control units $CCA_2$~$CCA_3$, respectively. The current control units $CCB_1$~$CCB_3$ are configured to regulate the current $I_{B1}$~$I_{B3}$ so that the current $I_{B1}$~$I_{B3}$ does not exceed the maximum current settings $I_{SET_B1}$~$I_{SET_B3}$ of the current control units $CCB_1$~$CCB_3$, respectively. When the current control unit $CCA_1$ is coupled to the luminescent devices $A_1$~$A_3$, the current control unit $CCA_1$ is configured to regulate the current $I_{A1}$ so that the current $I_{A1}$ does not exceed the maximum current setting $I_{SET_A1}$ of the current control unit $CCA_1$.

In the LED lighting device 100, the line voltage sensing unit 30 is configured to detect a voltage $V_S$ associated the range of the rectified AC voltage $V_{AC}$. For example, the voltage $V_S$ may be the peak voltage of the rectified AC voltage $V_{AC}$ or the average voltage of the rectified AC voltage $V_{AC}$. In an embodiment, the line voltage sensing unit 30 may be implemented using resistors R1-R2 and a capacitor C1 in a configuration as depicted in FIG. 1. The values of the resistors R1-R2 and the capacitor C1 are selected so that the current control unit $CCA_1$ may be turned on by the voltage $V_S$ which indicates that the rectified AC voltage $V_{AC}$ is within the 110 AC range, and may be turned off by the voltage $V_S$ which indicates that the rectified AC voltage $V_{AC}$ is within the 220 AC range. However, the configuration of the line voltage sensing unit 30 does not limit the scope of the present invention.

In the LED lighting device 100, the mode control unit 40 includes a switch QP and two path controllers D1~D2. The switch QP includes a first end coupled to the power supply circuit 110, a second end coupled to the luminescent devices $B_1$~$B_3$, and a control end coupled to the current control unit $CCA_3$. The path controller D1 includes a first end coupled between the luminescent device $A_3$ and the path controller D2, and a second end coupled between the switch QP and the luminescent device $B_1$. The path controller D2 includes a first end coupled to the luminescent device $A_3$, and a second end coupled to the current control unit $CCA_1$.

In the present invention, the switch QP may be implemented using a p-channel metal-oxide-semiconductor field-effect transistor (P-MOSFET), or other devices having similar function, or one or multiple devices which provides similar function. Each of the path controllers $D_1$~$D_2$ may adopt one or more diodes, one or more LED, one or more diode-connected field effect transistors (FET), one or more diode-connected bipolar junction transistors (BJT) or other devices having similar function, or a combination of one or multiple devices which provides similar function. However, the types and configurations of the devices for implementing the mode control unit 40 do not limit the scope of the present invention.

In the present invention, the LED lighting device 100 may further include two resistors R3-R4 and a Zener diode ZD. The resistor R3 and the Zener diode ZD are coupled between the first end and the control end of the switch QP. The resistor R4 is coupled between the control end of the switch QP and the current control unit $CCA_3$. The two resistors R3-R4 and the Zener diode ZD may optionally be introduced for providing the gate-to-source voltage ($V_{GS}$) protection for the P-MOSFET implementing the switch QP, but do not limit the scope of the present invention.

When the voltage established across a specific path controller exceeds its turn-on voltage, the specific path controller is forward-biased and functions as a short-circuited device; when the voltage established across the specific path controller does not exceed its turn-on voltage, the specific path controller is reverse-biased and functions as an open-circuited device. In the present invention, the mode control unit 40 is configured to allow the first luminescent unit (the luminescent devices $A_1$~$A_3$) to be coupled in series to or coupled in parallel with the second luminescent unit (the luminescent devices $B_1$~$B_3$) using the path controller D1~D2.

Figure 2:
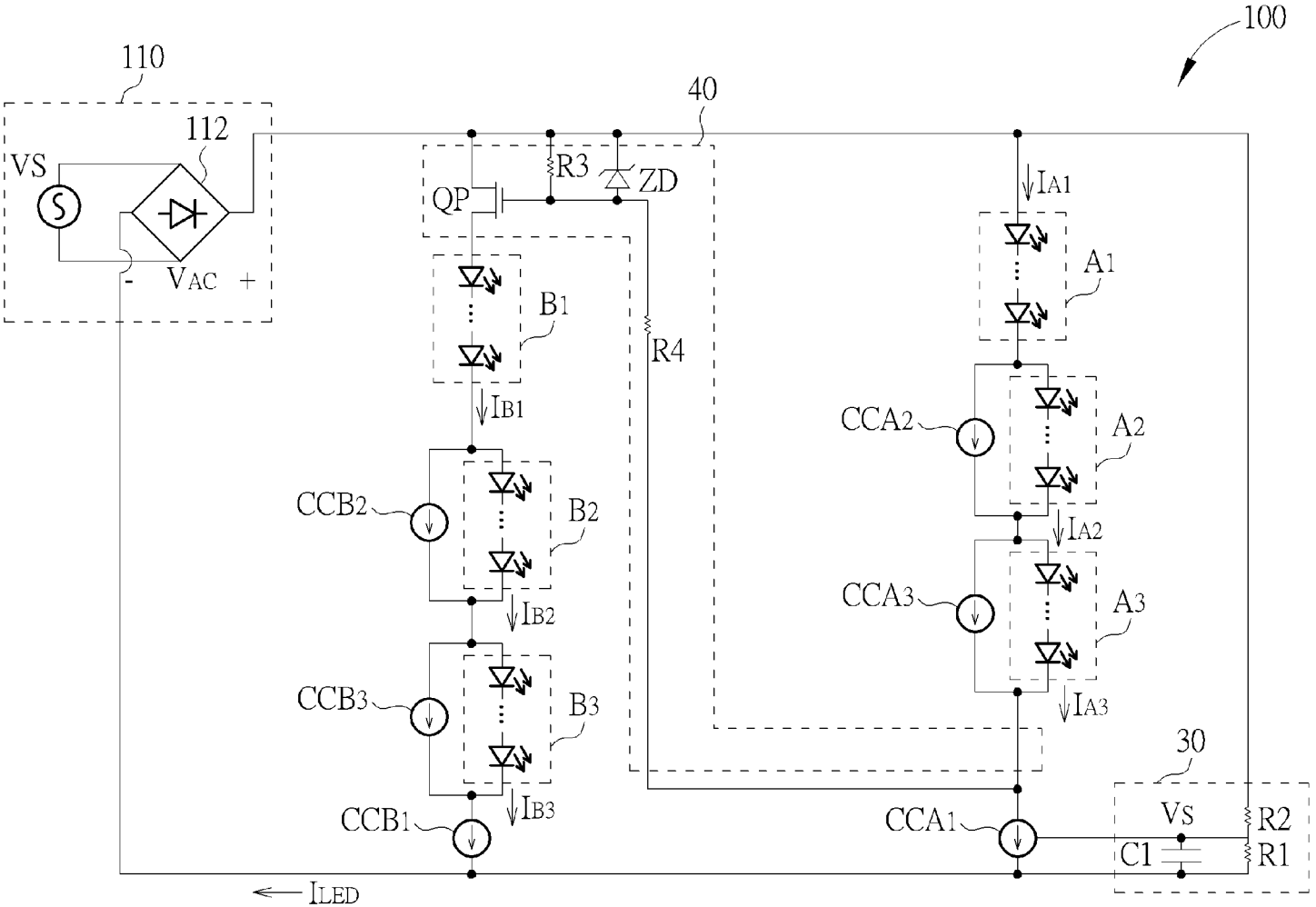
FIG. 2 is a diagram illustrating the equivalent circuit of the LED lighting device when operating in the 110V driving mode.

FIG. 2 is a diagram illustrating the equivalent circuit of the LED lighting device 100 when operating in the 110V driving mode. When detecting that the rectified AC voltage $V_{AC}$ is within the 110V AC range, the line voltage sensing unit 30 is configured to turn on the current control unit $CCA_1$, thereby pulling the second end of the path controller D2 and the control end of the switch QP to a relative low voltage level. Under such circumstances, the switch QP is turned on, the path controller D1 is reverse-biased, and the path controller D2 is forward-biased. With the series connection cut off by the reverse-biased path controller D1, the luminescent devices $A_1$~$A_3$ and the luminescent devices $B_1$~$B_3$ are coupled in parallel with each other and regulated independently by respective current control units ($I_{A1} \neq I_{B1}$). Via the forward-biased path controller D2, the current control unit $CCA_1$ is coupled in series to the luminescent device $A_1$~$A_3$, thereby capable of regulating the current $I_{A1}$. More specifically, the current control unit $CCA_1$ is configured to regulate the current $I_{A1}$ flowing through the luminescent device $A_1$ so that the current $I_{A1}$ does not exceed the current setting $I_{SET_A1}$ of the current control unit $CCA_1$; the current control unit $CCA_2$ is configured to regulate the current $I_{A2}$ flowing through the luminescent device $A_2$ so that the current $I_{A2}$ does not exceed the current setting $I_{SET_A2}$ of the current control unit $CCA_2$; the current control unit $CCA_3$ is configured to regulate the current $I_{A3}$ flowing through the luminescent device $A_3$ so that the current $I_{A3}$ does not exceed the current setting $I_{SET_A3}$ of the current control unit $CCA_3$. Similarly, the current control unit $CCB_1$ is configured to regulate the current $I_{B1}$ flowing through the luminescent device $B_1$ so that the current $I_{B1}$ does not exceed the current setting $I_{SET_B1}$ of the current control unit $CCB_1$; the current control unit $CCB_2$ is configured to regulate the current $I_{B2}$ flowing through the luminescent device $B_2$ so that the current $I_{B2}$ does not exceed the current setting $I_{SET_B2}$ of the current control unit $CCB_2$; the current control unit $CCB_3$ is configured to regulate the current $I_{B3}$ flowing through the luminescent device $B_3$ so that the current $I_{B3}$ does not exceed the current setting $I_{SET_B3}$ of the current control unit $CCB_3$.

Figure 3:
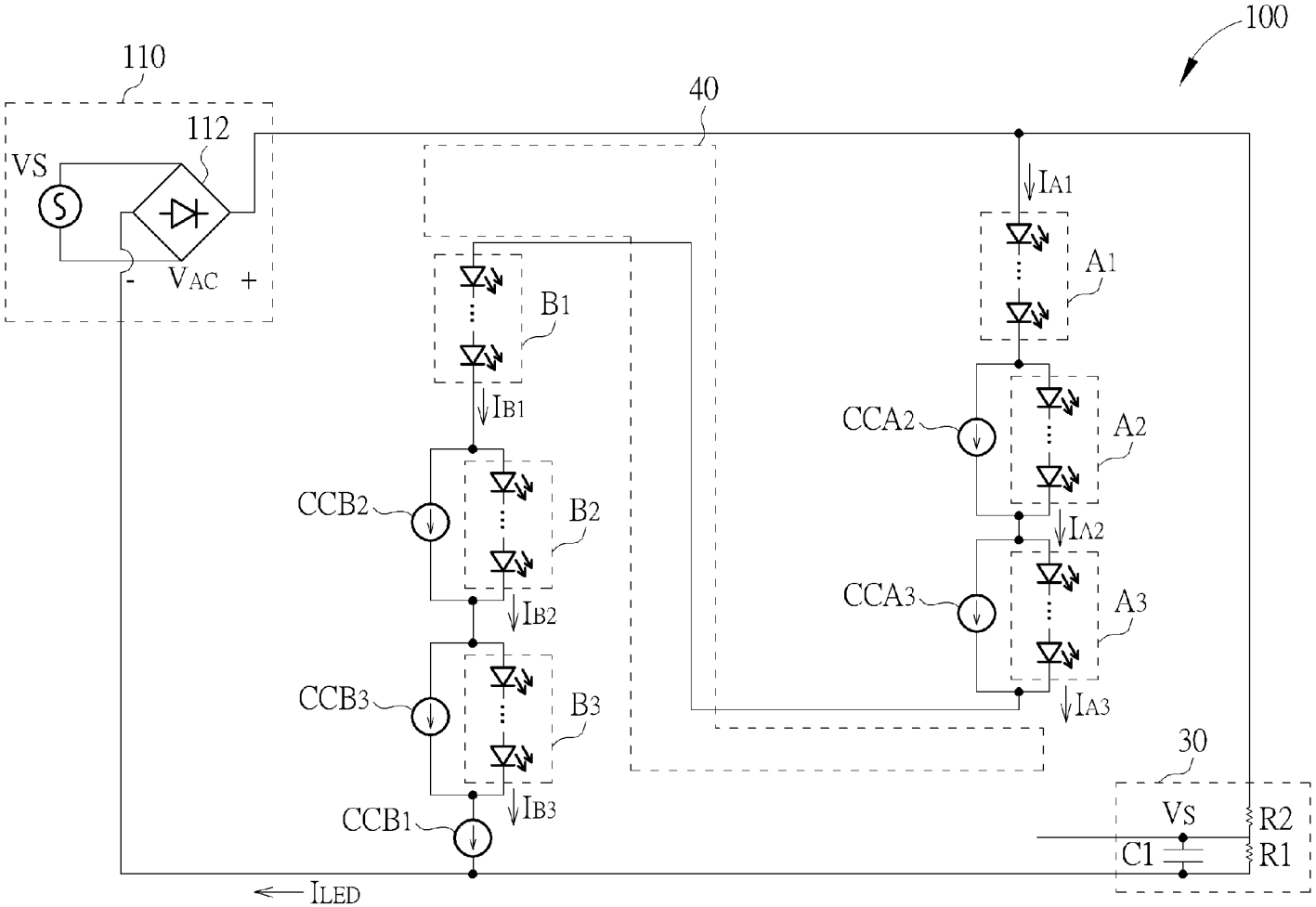
FIG. 3 is a diagram illustrating the equivalent circuit of the LED lighting device when operating in the 220V driving mode.

FIG. 3 is a diagram illustrating the equivalent circuit of the LED lighting device 100 when operating in the 220V driving mode. When detecting that the rectified AC voltage $V_{AC}$ is within the 220V AC range, the line voltage sensing unit 30 is configured to turn off the current control unit $CCA_1$, thereby pulling the control end of the switch QP to a relative high voltage level. Under such circumstances, the switch QP is turned off, the path controller D1 is forward-biased, and the path controller D2 is reverse-biased. Via the forward-biased path controller D1, the luminescent device $A_1$~$A_3$ are coupled in series to the luminescent device $B_1$~$B_3$. With the series connection cut off by the reverse-biased path controller D2, the current control unit $CCA_1$ is isolated from the luminescent devices $A_1$~$A_3$. In other words, the luminescent devices $A_1$ and $B_1$ are regulated by the same current control unit $CCB_1$. More specifically, the current control unit $CCA_2$ is configured to regulate the current $I_{A2}$ flowing through the luminescent device $A_2$ so that the current $I_{A2}$ does not exceed the current setting $I_{SET_A2}$ of the current control unit $CCA_2$; the current control unit $CCA_3$ is configured to regulate the current $I_{A3}$ flowing through the luminescent device $A_3$ so that the current $I_{A3}$ does not exceed the current setting $I_{SET_A3}$ of the current control unit $CCA_3$; the current control unit $CCB_1$ is configured to regulate the overall current $I_{LED}$ ($I_{LED}=I_{A1}=I_{B1}$) so that the current $I_{LED}$ does not exceed the current setting $I_{SET_B1}$ of the current control unit $CCB_1$; the current control unit $CCB_2$ is configured to regulate the current $I_{B2}$ flowing through the luminescent device $B_2$ so that the current $I_{B2}$ does not exceed the current setting $I_{SET_B2}$ of the current control unit $CCB_2$; the current control unit $CCB_3$ is configured to regulate the current $I_{B3}$ flowing through the luminescent device $B_3$ so that the current $I_{B3}$ does not exceed the current setting $I_{SET_B3}$ of the current control unit $CCB_3$.

Figure 4:
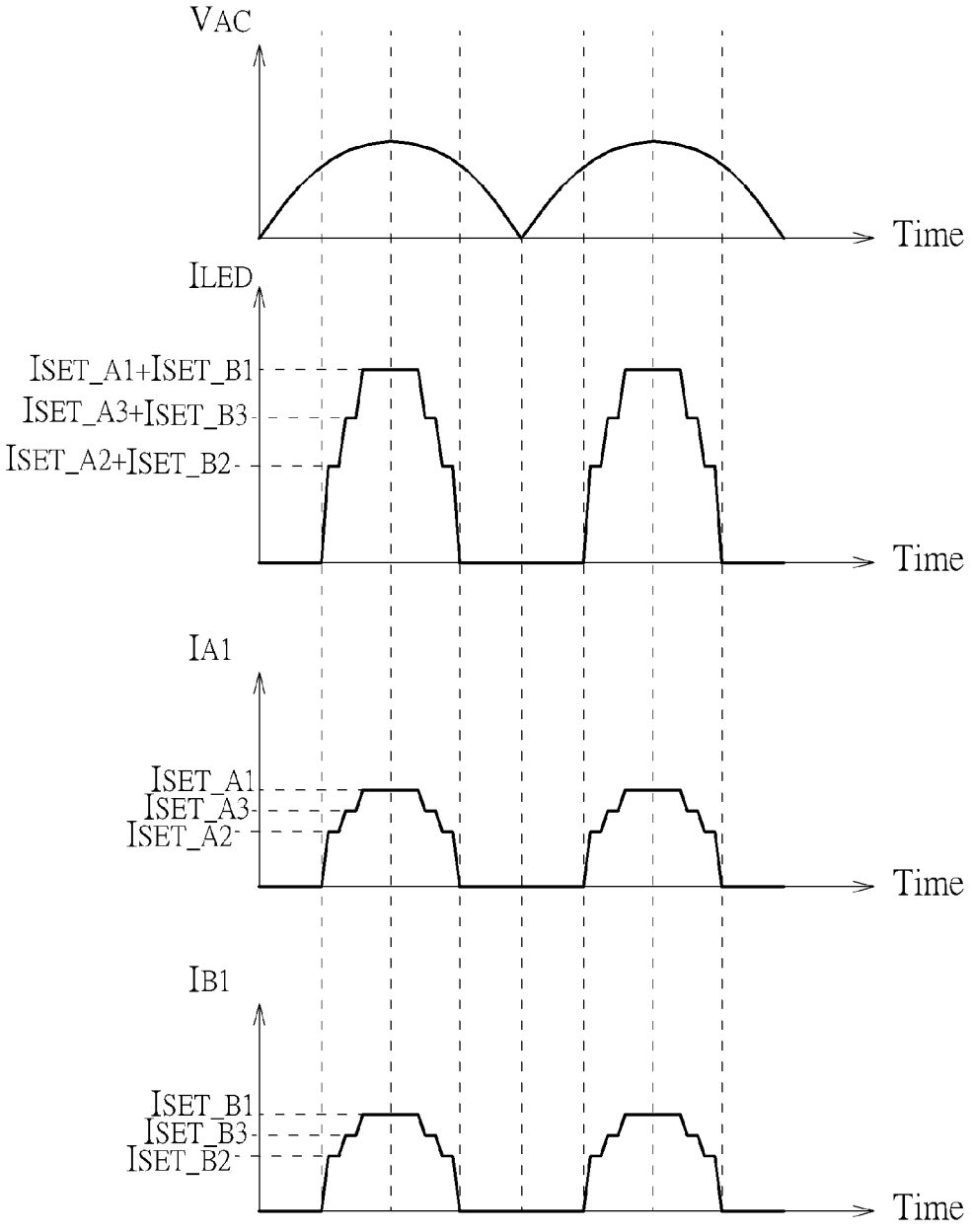
FIG. 4 is a diagram illustrating the voltage/current characteristics of the LED lighting device when operating in the 110V driving mode.
Figure 5:
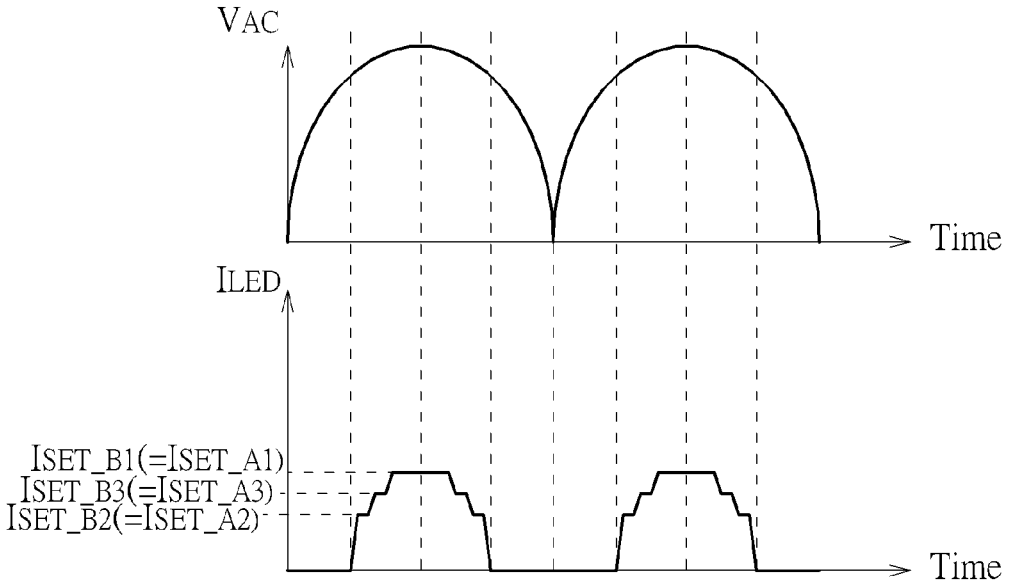
FIG. 5 is a diagram illustrating the voltage/current characteristics of the LED lighting device when operating in the 220V driving mode.

FIG. 4 is a diagram illustrating the voltage/current characteristics of the LED lighting device 100 when operating in the 110V driving mode. FIG. 5 is a diagram illustrating the voltage/current characteristics of the LED lighting device 100 when operating in the 220V driving mode. As depicted in FIGS. 4 and 5, the maximum value of the overall current $I_{LED}$ in the 110V driving mode is larger than the maximum value of the overall current $I_{LED}$ in the 220V driving mode. The characteristics of the current $I_{A1}$ and $I_{B1}$ remain the same in both the 110V and 220V driving modes in order to maintain the same flux performance. The system power of the LED lighting device 100 (integral of $V_{AC}$ and $I_{LED}$) also remains constant in both the 110V and 220V driving modes.

When operating in the 220V driving mode, the LED lighting device 100 is driven in 5 stages having respective maximum current levels of $I_{SET_A2}$, $I_{SET_B2}$, $I_{SET_A3}$, $I_{SET_B3}$ and $I_{SET_B1}$ ($I_{SET_B1}=I_{SET_A1}$), wherein $I_{SET_B1}$ has the largest value. In the embodiment depicted in FIG. 5 for illustrative purpose, it is assumed that the current setting $I_{SET_B1}$ is equal to the current setting $I_{SET_A1}$ the current setting $I_{SET_B2}$ is equal to the current setting $I_{SET_A2}$, and the current setting $I_{SET_B3}$ is equal to the current setting $I_{SET_A3}$. However, the relationship between the current settings $I_{SET_A2}$, $I_{SET_B2}$, $I_{SET_A3}$ and $I_{SET_B3}$ does not limit the scope of the present invention.

Although the LED lighting device 100 capable of operating in 110V/220V dual mode is used for illustrative purpose, the nominal values of the first and second AC ranges do not limit the scope of the present invention. In other embodiments, the LED lighting device 100 may operate in 100V/230V dual mode, 100V/240V, 110V/230V dual mode, 110V/240V dual mode, 120V/230V dual mode, 120V/240V dual mode, 100V/277V dual mode, 110V/277V dual mode and 120V/277V dual mode.

In the LED lighting device 100 capable of operating in 110V/277V dual mode or 120V/277V dual mode, the path controller $D_1$ may adopt multiple diodes, multiple LEDs, multiple diode-connected FETs, multiple diode-connected BJTs or multiple other devices capable of providing higher voltage endurance than that required when the nominal value of the second AC range is 220V, 230V and 240V.

With the above-mentioned multi-stage driving scheme, the present invention may turn on multiple luminescent devices flexibly using multiple current control units. With the above-mentioned mode control unit, the present LED lighting device may automatically switch between two driving modes according to the range of the rectified AC voltage. Therefore, the present invention can provide an LED lighting device capable of improving the effective operational voltage range and providing dual mode operations for two AC voltage ranges.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode (LED) lighting device having multiple driving stages and providing automatic mode switching, comprising:

a first luminescent unit driven by a rectified alternative-current (AC) voltage and comprising a plurality of luminescent devices coupled in series;

a second luminescent unit driven by the rectified AC voltage and comprising a plurality of luminescent devices coupled in series;

a first current controller selectively coupled in series to the first luminescent unit according to a sensing voltage associated a range of the rectified AC voltage and configured to provide a first current setting;

a second current controller coupled in series to the second luminescent unit and configured to provide a second current setting;

a line voltage sensing unit configured to detect the sensing voltage; and a mode control unit configured to:

operate the LED lighting device in a first driving mode when the sensing voltage indicates that the rectified AC voltage is within a first AC range by coupling the first current controller to the first luminescent unit and allowing the first luminescent unit and the second luminescent unit to be coupled in parallel with each other;

operate the LED lighting device in a second driving mode when the sensing voltage indicates that the rectified AC voltage is within a second AC range by isolating the first current controller from the first luminescent unit and allowing the first luminescent unit and the second luminescent unit to be coupled in series to each other, wherein:

the first current controller is configured to regulate first current flowing through the first luminescent unit so that the first current does not exceed the first current setting and the second current controller is configured to regulate second current flowing through the second luminescent unit so the second current does not exceed the second current setting when the LED lighting device operates in the first driving mode; and the first current controller is turned off and the second current controller is configured to regulate third current flowing through the first luminescent unit and the second luminescent unit so that the third current does not exceed the second current setting when the LED lighting device operates in the second driving mode.

2. The LED lighting device of claim 1, wherein the mode control unit comprises:

a switch including:

a first end coupled to a first end of the first luminescent unit;

a second end coupled to a first end of the second luminescent unit; and a control end coupled to the first current controller;

a first path controller including:

a first end coupled to a second end of the first luminescent unit; and a second end coupled to the first end of the second luminescent unit; and a second path controller including:

a first end coupled to the second end of the first luminescent unit; and a second end coupled to the control end of the switch.

3. The LED lighting device of claim 2, wherein the switch is a p-channel metal-oxide-semiconductor field-effect transistor (P-MOSFET).

4. The LED lighting device of claim 2, wherein the first path controller includes at least one diode, one LED, one diode-connected field effect transistor (FET), or one diode-connected bipolar junction transistor (BJT).

5. The LED lighting device of claim 1, further comprising:

a third current controller coupled in parallel with at least one luminescent device in the first luminescent unit and configured to regulate fourth current flowing through the at least one luminescent device in the first luminescent unit so that the fourth current does not exceed a third current setting of the third current controller.

6. The LED lighting device of claim 5, further comprising:

a fourth current controller coupled in parallel with at least one luminescent device in the second luminescent unit and configured to regulate fifth current flowing through the at least one luminescent device in the second luminescent unit so that the fifth current does not exceed a fourth current setting of the fourth current controller.

7. The LED lighting device of claim 6, wherein the third current setting is smaller than the first current setting and the fourth current setting is smaller than the second current setting.

8. The LED lighting device of claim 1, wherein a first nominal value of the first AC range is smaller than a second nominal value of the second AC range.

9. The LED lighting device of claim 8, wherein:

the first nominal value is 100V, 110V or 120V; and the second nominal value is any of 220V, 230V, 240V and 277V.

* * * * *